United States Patent [19]

Rebish

[11] 4,289,049

[45] Sep. 15, 1981

[54] BOLT HOLDING MACHINE WRENCH

[75] Inventor: Edward J. Rebish, Euclid, Ohio

[73] Assignee: The Lamson & Sessions Co., Cleveland, Ohio

[21] Appl. No.: 80,196

[22] Filed: Oct. 1, 1979

[51] Int. Cl.[3] ..... B25B 17/00

[52] U.S. Cl. ..... 81/56

[58] Field of Search ..... 81/55, 56

[56] References Cited

U.S. PATENT DOCUMENTS

| | | | |
|---|---|---|---|
| 2,789,597 | 4/1957 | La Torre | 81/55 |
| 2,882,773 | 4/1959 | Wing | 81/55 |
| 2,955,496 | 10/1960 | La Torre | 81/56 |
| 3,247,741 | 4/1966 | Batten | 81/55 |
| 3,323,394 | 6/1967 | Bangerten et al. | 81/55 |
| 3,323,395 | 6/1967 | Burnett et al. | 81/55 |
| 3,394,623 | 7/1968 | Kinakin | 81/55 |
| 3,584,527 | 6/1971 | Bosten | 81/56 |
| 3,916,734 | 11/1975 | Sawan | 81/56 |
| 4,165,660 | 8/1979 | Behrens | 81/55 |

FOREIGN PATENT DOCUMENTS

| | | |
|---|---|---|
| 1243172 | 12/1959 | France . |

*Primary Examiner*—James L. Jones, Jr.

*Attorney, Agent, or Firm*—Yount & Tarolli

[57] ABSTRACT

An improved power tool is utilized to tighten a connection between internally and externally threaded fastener elements. The power tool includes a motor which drives a socket which engages the internally threaded fastener element, such as a nut. A retainer rod extends through a central passage in a socket drive member to engage an exposed end of an externally threaded member, such as a bolt. An assembly is provided to hold the retainer rod against rotation with the socket and to apply an axially directed force to the retainer rod to urge it into engagement with the bolt. This assembly includes a piston which is releasably connected with the retainer rod and is spring biased toward one end of a chamber. As the nut is tightened onto the bolt, the piston is retracted into the chamber against the influence of the spring. The connection which secures the piston to the retainer rod is releasable to enable the retainer rod to be moved axially relative to the piston to vary the extent to which it projects into the socket. The piston and piston chamber have polygonal cross sectional configurations so that the side surfaces of the chamber hold the piston and retainer rod against rotational movement relative to the casing of the power tool.

17 Claims, 7 Drawing Figures

BOLT HOLDING MACHINE WRENCH

BACKGROUND OF THE INVENTION

This invention relates to a tool and more specifically to a power tool which is used to tightened a connection between internally and externally threaded fastener elements.

Power tools have previously been utilized to tighten connections between internally and externally threaded fastener elements, that is between nuts and bolts. Some of these power tools are provided with retainer rods which engage the end of the bolt to hold it against rotation as the nut is tightened. These known power tools can advantageously be utilized in environments where a single operator must tighten a substantial number of connections and/or in environments where there is limited access to one side of the connection. Typical of these known power tools are the ones disclosed in U.S. Pat Nos. 3,584,527; 3,323,395; 3,323,394; 3,247,741; 2,882,773; and 2,789,597.

Although these known power tools are more or less satisfactory in their mode of operation, difficulty has been encountered when sockets having different axial lengths are to be used with the power tool. This is because the retainer rod must extend further outwardly from a socket drive member when a relatively long socket is to be used than when a relatively short socket is to be used. In addition, it may be desired to use the power tool without the retainer rod. With certain known power tools, removal of the retainer rod is relatively difficult, if not impossible. At least some of these known power tools have retainer rods which are held against rotational movement by hollow sleeves or other members which are built into the power tool. This construction makes it extremely difficult, if not impossible, to change the size of the retainer rod which is to be utilized in association with the power tool.

SUMMARY OF THE PRESENT INVENTION

The present invention provides a new and improved tool for use in tightening a connection between internally and externally threaded fastener elements. A retainer rod is provided in association with the tool to hold an externally threaded fastener element, such as a bolt, against rotation during tightening of an internally threaded fastener element, such as a nut. The retainer rod is held against rotation with the socket which drives the nut and is urged into engagement with the bolt by an assembly which includes a noncircular piston which is releasably connected with the retainer rod. The releasable connection between the piston and the retainer rod enables the axial extent to which the retainer rod projects into the socket which engages the nut to be varied to accommodate sockets of different lengths. The noncircular piston cooperates with the side walls of a piston chamber to hold the retainer rod against rotational movement with the socket.

In one embodiment of the invention, the piston chamber is disposed in tubular wall having an open end portion which is connected with a casing of the tool and a second open end portion which is closed by a cover. If it is desired to use the tool without the retainer rod, the tubular wall is disconnected from the casing and the retainer rod removed. The cover which closes one end of the tubular wall is then utilized to close the opening in the casing. Since the piston and retainer rod are readily accessible, the retainer rod can be readily replaced with retainer rods of different sizes for use in association with fastener elements of different sizes.

Accordingly, it is an object of this invention to provide a new and improved tool having a retainer rod which holds a fastener element against rotation and wherein the retainer rod is connected with a piston by a releasable connection to enable the distance which the retainer rod projects outwardly from the tool to be adjusted.

Another object of this invention is to provide a new and improved tool having retainer rod which engages a fastener element and wherein the retainer rod is held against rotation by the interaction between a noncircular piston and a piston chamber having a noncircular cross sectional configuration.

Another object of this invention is to provide a new and improved tool having a retainer rod which is connected with a piston disposed in a tubular sidewall which is releasably connected with a casing of the tool to enable the tubular sidewall and retainer rod to be removed from the power tool and wherein a cover at one end of the tubular sidewall is used to close an opening in the casing when the tubular sidewall and retainer rod are removed from the tool.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
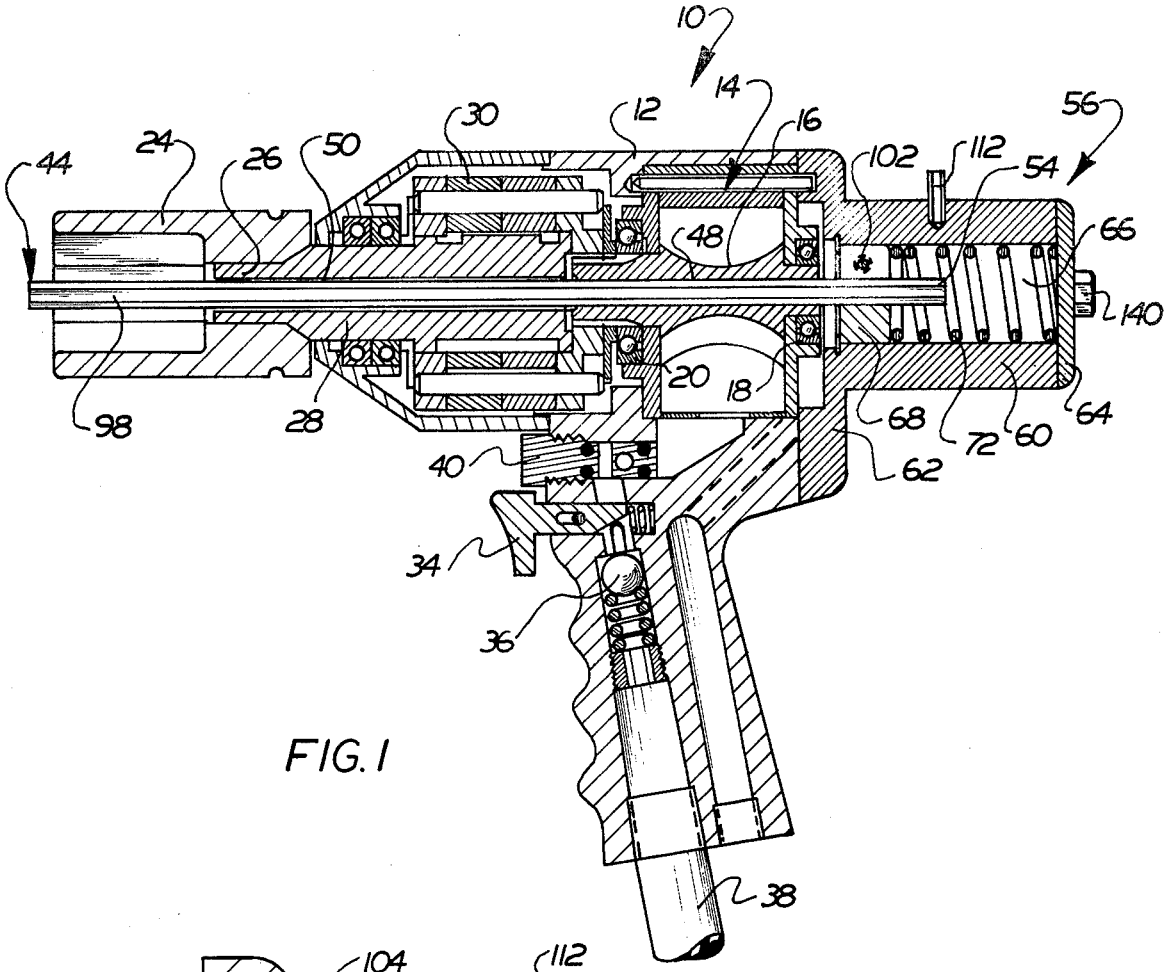
FIG. 1 is a sectional view of a power tool constructed in accordance with the present invention.

A power tool (FIG. 1) includes a rigid metal casing 12 in which a fluid motor 14 is disposed. The motor 14 includes a rotor or drive member 16 which is rotatably supported by bearings 18 and 20. During operation of the power tool 10, the motor 14 is operated to rotate a socket 24 about its longitudinally extending central axis to tighten a connection between internally and externally threaded fastener elements, such as a nut and bolt. The socket 24 is connected with an axially outer end portion 26 of a rotatable socket drive member 28 which is connected with the motor rotor 16 through a hammer and anvil assembly 30.

To operate the power tool 10, a trigger 34 is actuated to open a valve 36 to enable air under pressure to flow from a conduit 38 to the motor 14. The high pressure air drives the motor 14 in a well known manner. Although a fluid motor 14 is utilized in the embodiment of the invention illustrated in FIG. 1, it is contemplated that other types of motors could be utilized if desired.

During operation of the motor 14, the rotor 16 operates the hammer and anvil assembly 30 in a known manner to rotate the socket drive element 28 and socket 24. The rotational movement of the socket 24 is utilized to tighten a nut onto a bolt. A directional control valve 40 is actuatable to reverse the direction of operation of the motor 14 to enable the power tool 10 to be utilized to loosen a fastener assembly.

During rotation of the nut relative to the bolt by the socket 24, the bolt tends to rotate about its central axis due to the interaction between the internal threads on the nut with the external threads on the bolt. Therefore, a stationary retainer rod 44 (FIG. 1) is provided to hold the bolt against rotational movement with the nut. The straight metal retainer rod 44 extends longitudinally through a central passage 48 formed in the motor rotor 16 and through a central passage 50 formed in the socket drive member 28. The cylindrical passages 48 and 50 are axially aligned with each other and with the central axis of the socket 24 so that the retainer rod 44 is disposed in a coaxial relationship with the motor 14, socket drive member 28 and socket 24. The passages 48 and 50 are large enough in cross sectional area so that the motor rotor 16 and socket drive member 28 can rotate about the central axis of the retainer rod 44 without interference with the stationary retainer rod.

The retainer rod 44 has an inner end portion 54 (see FIGS. 1 and 2) which extends through an opening in the casing 12 into an assembly 56 which performs the dual functions of holding the retainer rod 44 against rotation relative to the casing and applying an axially directed force to the retainer rod to urge it into engagement with a bolt. The assembly 56 includes a tubular metal wall 60 (FIG. 2) which is integrally formed with a mounting flange 62. The mounting flange 62 forms part of the casing 12 of the power tool 10 (see FIG. 1). The tubular wall 60 cooperates with a cover 64 to define an axially extending piston chamber 66.

Figure 2:
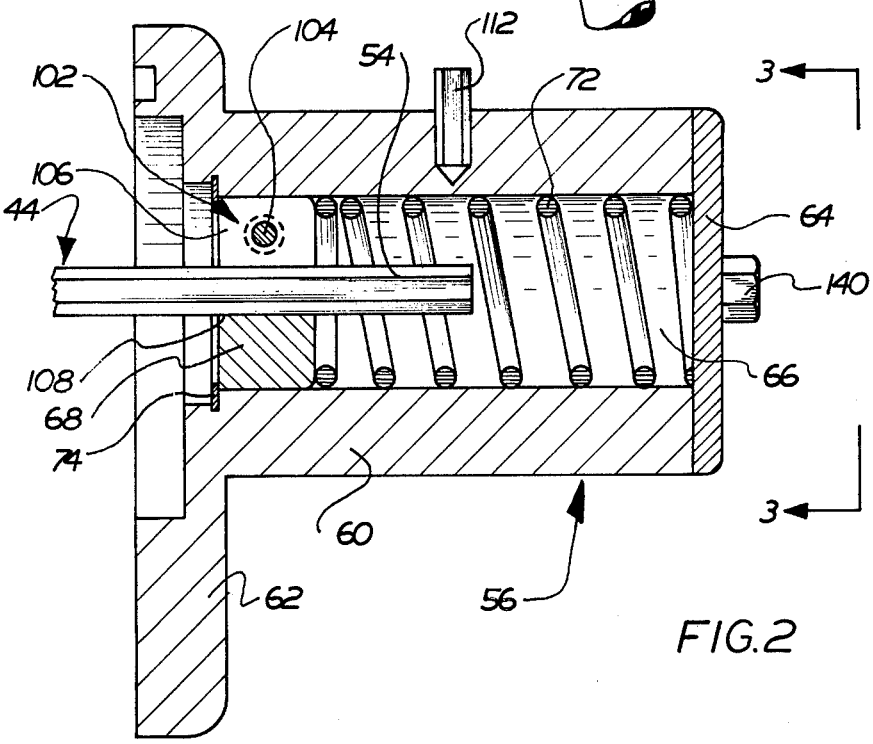
FIG. 2 is an enlarged sectional view of an assembly used in the power tool of FIG. 1 to hold a retainer rod against rotation and to urge the retainer rod into engagement with a fastener element when the power tool is used to tighten a connection between a pair of fastener elements.

A metal piston 68 is disposed in the chamber 66 and holds the retainer rod 44 against rotation about its longitudinally extending central axis. A coil spring 72 is disposed in the chamber 66 and is effective to apply a force against the piston 68 to urge it toward the initial position at inner end of the chamber 66 (FIG. 2). When the piston 68 is in the initial position, it is pressed against a stop ring 74 by the spring 72.

The retainer rod 44 is pressed axially against the end portion of the bolt as the socket 24 is moved into engagement with a nut. The axial force applied to the retainer rod 44 causes the piston 68 to move toward the right (as viewed in FIG. 2) from the initial position to a retracted position in which the piston is disposed closer to the cover 64. This rightward movement (as viewed in FIG. 2) of the retainer rod 44 and piston 68 reduces the telescopic relationship between the retainer rod 44 and the socket 24 (see FIG. 1) as the socket is moved into engagement with a nut. During operation of the motor 14, the socket rotates the nut to turn it onto a bolt. As this occurs, the retainer rod is moved further toward the right (as viewed in FIGS. 1 and 2) against the influence of the spring 72.

To hold the retainer rod 44 against rotation with the socket 24, the piston 68 and chamber 66 have noncircular cross sectional configurations (see FIG. 3) in a plane extending perpendicular to the longitudinal central axes of the retainer rod and chamber 66. Thus, the chamber 66 has a polygonal cross sectional configuration formed by a plurality of flat side surfaces, that is a pair of parallel flat side wall surfaces 76 and 78 and a second pair of parallel flat side wall surfaces 80 and 82. The piston 68 also has a polygonal configuration which is defined by a pair of parallel side surfaces 86 and 88 and a second pair of parallel side surfaces 90 and 92. The flat side surfaces 86, 88, 90 and 92 of the piston 68 are disposed in abutting sliding engagement with the side surfaces 76, 78, 80 and 82 of the chamber 66.

During use of the power tool 10, the polygonal piston 68 is slid along the side walls of the chamber 66. It is contemplated that it will be easier to replace the piston 68 than to replace the tubular side wall 60. Therefore, the surfaces 76, 78, 80 and 82 of the piston chamber 66 are harder than the surfaces 86, 88, 90 and 92 of the piston. This results in the piston 68 wearing to a greater extent than the tubular side wall 60. Although in the illustrated embodiment of the invention, the chamber 66 is machined in the metal wall 60 and the surfaces 76, 78, 80 and 82 subsequently hardened, it is contemplated that a hard metal liner could be utilized or the wall 60 could be formed of a relatively hard metal if desired. Alternatively, the piston 68 could be formed of a suitable polymeric material which would slide easily along the side surfaces of the metal chamber wall 66.

Figure 3:
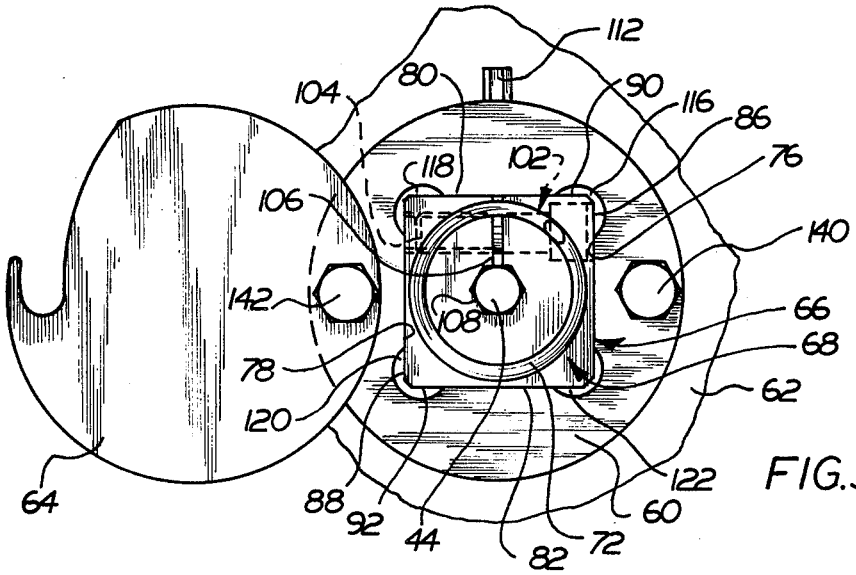
FIG. 3 is an end view, taken generally along the line 3—3 of FIG. 2, illustrating the relationship between a cylinder chamber and a noncircular piston which holds the retainer rod against rotational movement, a cover to the piston chamber being shown in an open position.

Although the noncircular piston 68 and chamber 66 have been shown in FIG. 3 as having square cross sectional configurations, it is contemplated that other noncircular cross sectional configurations could be utilized if desired. In fact, the piston 68 and chamber 66 could be provided with arcuate side surfaces if desired, so long as they interacted to hold the piston and retainer rod 44 against rotational movement relative to the casing of the power tool.

In accordance with a feature of the present invention, the extent to which an outer end portion 98 (see FIG. 1) of the retainer rod 44 projects form the socket drive member 28 can be adjusted. To vary the extent to which the retainer rod 44 projects outwardly from the socket drive member 28, a connection 102 (see FIG. 3) is released to enable the retainer rod to be moved axially relative to the piston 68. The connection 102 includes a bolt 104 which extends across a slot 106 in the piston 68. The slot 106 opens outwardly from a polygonal passage or opening 108 through the piston 68 (see FIGS. 2 and 3). The passage 108 through center of the piston 68 has a polygonal cross sectional configuration which is the same as the cross sectional configuration of the retainer rod 44 (see FIG. 3).

When the bolt 104 is loosened, the piston rod 44 can be slid axially through the passage 108 in the piston 68. When the outer end portion 98 (see FIG. 1) of the retainer rod 44 extends outwardly from the socket drive member 28 to the desired extent, the bolt 104 (FIGS. 2 and 3) is tightened to decrease the width of the slot 106.

This clamps the piston 68 against the side surfaces of the retainer rod 44 to hold it against axial and rotational movement relative to the piston.

It is contemplated that an operator of the power tool 10 may want to loosen the connection 102 to vary the axial position of the retainer rod 44 under conditions in which there is limited accessibility to tools for loosening the bolt 104. Therefore, the head of the bolt 104 is provided with a socket which can be engaged by a tool 112 mounted on the cylinder wall 60. The tool 112 is used to loosen the bolt 104 in the much same manner as in which an Allen wrench is commonly utilized to loosen bolts or set screws. The tool 112 has a hexagonal cross sectional configuration and is telescopically received in a similarly shaped socket formed in the head of the bolt 104. Since the relatively short tool 112 is fixedly connected with the side wall 60, it can be utilized to rotate the bolt 104 to either loosen or tighten the connection 102.

During use of the power tool 10, the piston 68 will move axially in the chamber 66. In order to prevent air from being trapped in opposite ends of the chamber 66, a plurality of passages 116, 118, 120 and 122 (FIG. 3) are formed between the piston 68 and the side wall of the chamber 66. The passages 116, 118, 120 and 122 extend throughout the axial length of the chamber 66 and enable air to flow freely between opposite of the piston 68. In addition, the open areas formed by the passages 116, 118, 120 and 122 facilitate machining of the chamber 66.

Figure 4:
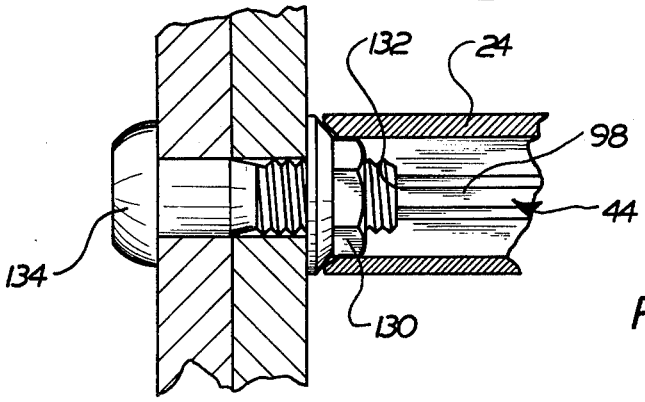
FIG. 4 is a fragmentary sectional view illustrating the manner in which a socket driven by the power tool of FIG. 1 engages a nut and in which the stationary retainer rod engages one end of a bolt to hold the bolt against rotation with the nut.

When the power tool 10 is to be used to tighten a connection, the socket 24 engages an internally threaded member or nut 130 (see FIG. 4). Prior to engagement of the socket 24 with the nut 130, the solid retainer rod 44 extends into a socket formed in the outer end portion 132 of an externally threaded member or bolt 134. Upon actuation of the trigger 34 (FIG. 1) the motor 14 is operated to cause the rotor 16 to rotate the socket drive member 28 and the socket 24. This results in the nut 130 being rotated about the central axis of the socket 24 and retainer rod 44. As this is occurring, the retainer rod 44 holds the bolt 134 against rotational movement.

As the nut 130 is tightened onto the bolt 134, the extent to which the bolt extends into the socket 24 increases. As this occurs, the retainer rod 44 is moved axially toward the right (as viewed in FIGS. 1 and 4) against the influence of the biasing spring 72 (FIG. 1). When the nut 130 has been tightened onto the bolt 134 (FIG. 4), the socket 24 is disengaged from the nut and the biasing spring 72 is effective to move the retainer rod 44 back to the initial position shown in FIG. 1. Although it is preferred to have the retainer rod 44 directly engage the bolt 134, a suitable bit could be used between the end of the retainer rod and the bolt if desired.

During operation of the power tool 10, it may be desirable to change the socket 24 to use a longer socket. When a longer socket 24 is used, the extent to which the retainer rod 44 extends outwardly from the socket drive member 28 is increased. To accomplish this, a cover retaining bolt 140 (see FIG. 3) is loosened and the cover 64 is pivoted about a second bolt 142 to the open position shown in FIG. 3. The coil spring 72, piston 68 and retainer rod 44 are then removed from the power tool 10.

Once the piston 68 has been removed from the chamber 66, the connection 102 is then loosened by rotating the bolt 104 with the tool 112. After the position of the retainer rod 44 has been adjusted relative to the piston 68, the tool 112 is again used to tighten the bolt 104 to hold the retainer rod against axial movement relative to the piston. The piston 68 and retainer rod 44 are then inserted back into the power tool 10 and the spring 72 is positioned in the chamber 66. The cover 44 is then pivoted to the closed position and the fastener 140 secured. When the cover 44 is closed, the spring 72 is compressed to apply a biasing force against the piston 68 urging it to the initial position shown in FIG. 2.

The construction of the assembly 56 enables the retainer rod 44 to be readily replaced by either a larger retainer rod or a smaller retainer rod. Although the connection 102 will allow the size of the piston 68 to expand and/or contract slightly, it is contemplated that when a substantially larger or smaller retainer rod 44 is to be utilized, different pistons 68 having appropriately sized passages 108 will be used in association with these retainer rods. It should be noted that the retainer rod 44, piston 68 and coil spring 72 can be readily removed from the power tool 10 to enable the power tool to be used without the retainer rod 44.

In the embodiment of the invention shown in FIGS. 1–4, the retainer rod 44 is solid and is received in a socket formed in the outer end portion of the bolt 134. In the embodiment of the invention shown in FIGS. 5 and 6, the retainer rod 44 is hollow and forms a socket which receives a projection on the end of the bolt. Since the embodiment of the invention shown in FIGS. 5 and 6 is generally similar to the embodiments of the invention shown in FIGS. 1–4, similar numerals will be utilized to designate similar components, the suffix letter "a" being associated with the numerals of FIGS. 5 and 6 in order to avoid confusion.

Figure 5:
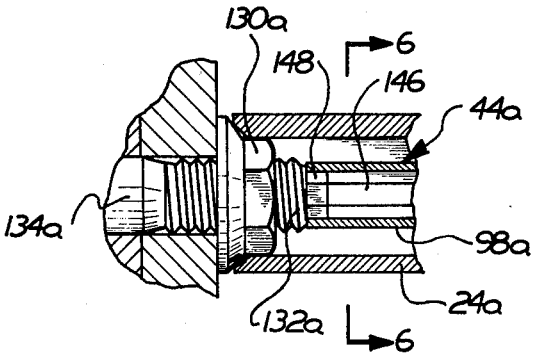
FIG. 5 is a fragmentary sectional view, generally similar to FIG. 4, illustrating an embodiment of the invention in which the retainer rod is hollow and engages a polygonal drive element formed on one end of the bolt.
Figure 6:
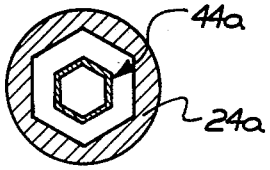
FIG. 6 is a sectional view, taken generally along the line 6—6 of FIG. 5, further illustrating the relationship between the retainer rod and socket.

In the embodiment of the invention shown in FIGS. 5 and 6, the retainer rod **44*a* has an outer end portion 98*a* which forms a socket 146. The tubular retainer rod 44*a* and socket 146 have hexagonal configurations (FIG. 6). A hexagonal projection 148 on the outer end portion 132*a* of a bolt 134*a* is received in the socket 146 (FIG. 5). The retaining rod 44*a* cooperates with the end portion 148 of the bolt 134*a* to hold the bolt against rotation as the main socket 24*a* rotates a nut 130*a* to tighten a connection between the nut and bolt. Although the hollow retainer rod 44*a* has been shown as having a cross sectional configuration which corresponds to the interior cross sectional configuration of the socket 24*a***, it is contemplated that the retainer rod could have other cross sectional configurations if desired.

In the embodiment of the invention shown in FIGS. 1–4, the socket 24 is disposed in a coaxial relationship with the motor 14. It is contemplated that it may be desirable to provide the power tool with an angle drive unit as in the embodiment of the invention shown in FIG. 7. Since the embodiment of the invention shown in FIG. 7 has many components which are generally similar to components of the embodiment of the invention shown in FIGS. 1–4, similar numerals will be utilized to designate similar components, the suffix letter "b" being associated with the numerals of FIG. 7 in order to avoid confusion.

A power tool **10*b* (FIG. 7) has a main section 152 which has the same general construction as the power tool 10 of FIG. 1. In addition, the power tool 10*b* includes an angle drive section or unit 154 which is connected with the fluid motor in the main section 152 to drive a socket 24*b* about an axis which extends perpendicular to the axis of rotation of a motor rotor. Thus, socket 24***b* is connected with the motor in the main section 152 through a rotatable socket drive member 28*b*. The main section 152 and angle drive section 154 have a casing 12*b* which includes a casing section 156 into which the socket drive member 28*b* extends into engagement with a drive sleeve 158.

The drive sleeve 158 is connected with a bevel pinion gear 162 which is rotatably supported by a bearing 164. The bevel gear 162 is disposed in meshing engagement with a second bevel gear 168. The second bevel gear is integrally formed with a second socket drive member 170 which is connected with the socket 24*b* and functions in much the same manner as does the socket drive member 28*b*. The socket drive member 170 is rotatably supported in the casing 12*b* by a bearing 172.

The socket drive member 170 and socket 24*b* rotate about a common central axis. This axis extends perpendicular to the central axis of the motor in the main section 152 of the power tool 10*b*. The retainer rod 44*b* extends perpendicular to the central axis of the motor and is disposed in a coaxial relationship with the socket drive member 170 and socket 24*b*.

Figure 7:
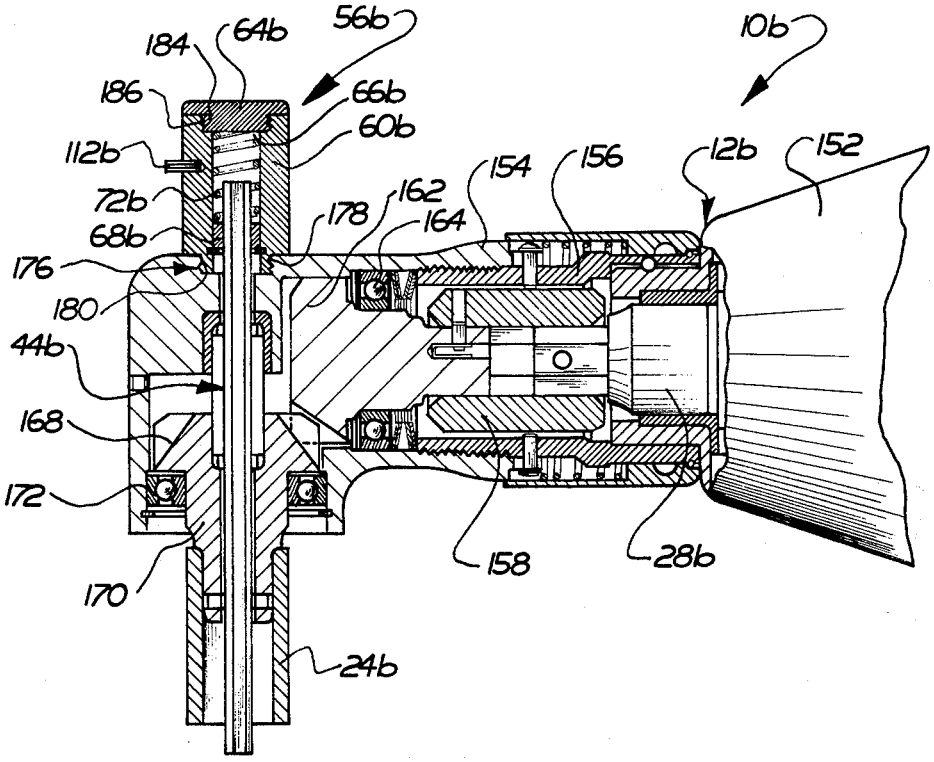
FIG. 7 is a fragmentary sectional view of an embodiment of the invention in which the power tool includes an angle drive unit.

An assembly 56*b* is provided to perform the dual functions of holding the retainer rod 44*b* against rotation relative to the casing 12*b* and of urging the retainer rod 44*b* axially outwardly (downwardly as viewed in FIG. 7). The assembly 56*b* includes a hollow tubular wall 60*b* which is connected with the casing 12*b* at a connection 176. The connection 176 includes internal threads 178 formed in the casing 12*b* and external threads 180 formed on an end portion of the tubular metal wall 60*b*. A cover 64*b* is connected with the opposite end of the hollow tubular wall 60*b*. The metal cover 64*b* has external thread convolutions 184 which engage internal thread convolutions 186 formed in a circular recess in the end portion of the tubular wall 60*b*.

The retainer rod 44*b* extends through an opening in a piston 68*b* which is disposed in a piston chamber 66*b*. The piston 68*b* and chamber 66*b* have polygonal cross sectional configuration. This enables the piston 68*b* and tubular wall 60*b* cooperate to hold the retainer rod 44*b* against rotation about its central axis. A spring 72*b* is disposed in the chamber 66*b* and urges the piston toward the initial position shown in FIG. 7.

When the retainer rod 44*b* engages a socket formed in the end portion of a bolt or other externally threaded fastener member, the piston 68*b* is forced upwardly (as viewed in FIG. 7) against the influence of the spring 72*b*. This moves the piston 68*b* toward a retracted position in which the piston is spaced further from the socket 24*b*. The sides of the polygonal chamber 66*b* are harder than the sides of the piston 68*b* to retard wear of the cylinder wall 60*b*.

The piston 68*b* has the same construction as the piston 68 of FIGS. 2–4 and includes a connector assembly similar to the connector assembly 102 to hold the retainer rod 44*b* against axial and rotational movement relative to the piston 68*b*. The connector assembly associated with the piston 68*b* is releasable to enable the axial position of the retainer rod 44*b* to be adjusted. The piston 68*b* has a generally square configuration and cooperates with side surfaces in the chamber 66*b* which are disposed in a square array in the same manner as are the side surfaces of the chamber 66 (see FIG. 3).

In accordance with a feature of this embodiment of the invention, the tubular wall 60*b* can be disconnected from the casing 12*b* and the retainer rod 44*b* removed from the power tool 10*b*. To accomplish this, the tubular side wall 60*b* is rotated about the central axis of the retainer rod 44*b*. As this occurs, the external threads 180 in the end portion of the tubular wall 60*b* become disengaged from the threads 178 and the casing 12*b*. The retainer rod 44*b* is then pulled axially outwardly through the opening in the casing.

If the power tool 10*b* is to be used without the retainer rod 44*b*, the cover 64*b* can be removed from the outer end portion of the tubular wall 60*b* and connected with the casing 12*b* to block the opening through which the retainer rod 44*b* formerly extended. Thus, the external threads 184 on the cover 64*b* are of the same size as the external threads 180 on the lower end portion of the tubular wall 60*b*. Therefore, the threads 184 on the cover 64*b* can be readily turned into engagement with the internal threads 178 in the casing 12*b*.

Although the open ended tubular wall 60 has been shown in FIG. 1 as being integrally formed with the flange 62, it is contemplated that the tubular wall 60 could be formed in the same manner as in which the tubular wall 60*b* of FIG. 7 is formed. If this was done, the flange 62 (FIG. 1) would form part of the main casing and the tubular wall 60 would be threaded at its inner end to engage a threaded opening in the flange 62. In addition, the cover 64 of FIG. 1 could be replaced by a threaded cover having a construction similar to the cover 64*b* of FIG. 7. If this was done, the external threads on the cover would be of the same size as the external threads on the end portion of the housing of the wall to enable the cover to be connected with the casing to block the casing opening which results from removal of the tubular wall 60 and retainer rod 44 from the power tool 10.

In view of the foregoing it is apparent that the present invention provides a new and improved power tool 10 for use in tightening a connection between internally and externally threaded fastener elements 130 and 134. A retainer rod 44 is provided in association with the power tool to hold an externally threaded fastener element, such as the bolt 134, against rotation during tightening of an internally threaded fastener element, such as the nut 130. The retainer rod 44 is held against rotation with the socket 24 which drives the nut 130 and is urged into engagement with the bolt 134 by an assembly 156 which includes a noncircular piston 68 which is releasably connected with the retainer rod 44. The releasable connection 102 between the piston 68 and the retainer rod 44 enables the axial extent to which the retainer rod projects into the socket 24 which engages the nut 130 to be varied to accommodate sockets 24 of different lengths. The noncircular piston 68 cooperates with the side surfaces 76, 78, 80 and 82 of a piston chamber 66 to hold the retainer rod 44 against rotational movement with the socket.

In one embodiment of the invention (FIG. 7), the piston chamber is disposed in tubular wall 60*b* having an open end portion 176 which is connected with the casing of the power tool and a second open end portion which is closed by a cover 64*b*. If it is desired to use the power tool without the retainer rod 44*b*, the tubular wall 60*b* is disconnected from the casing 12*b* and the retainer rod removed. The cover 64*b* which closes one end of the tubular wall 60*b* is then utilized to close the opening in the casing. If desired, the assembly 56 of FIGS. 1 and 2 could have a tubular sidewall 60 and cover 64 constructed in the same manner as the tubular sidewall 60*b* and cover 64*b* of FIG. 7.

Having described specific preferred embodiments of the invention, the following is claimed:

1. A power tool for use in tightening a connection between internally and externally threaded fastener elements, said power tool comprising a casing, a motor disposed within said casing, said motor including a rotatable drive member, a rotatable socket drive element connected with said rotatable drive member in said motor and adapted to be connected with a socket which engages the internally threaded fastener element, said socket drive element having a central passage extending therethrough, a retainer rod extending through the central passage in said socket drive element, said retainer rod having a first end portion which projects axially outwardly from said socket drive element and is connectable with the externally threaded fastener element to hold the externally threaded fastener element against rotation during rotation of the internally threaded fastener element by the socket and a second end portion which extends through an opening in said casing, and means for holding said retainer rod against rotation with said socket drive member and for applying an axially directed force to said retainer rod to urge said retainer rod toward said externally threaded fastener element, said means for holding said retainer rod against rotation and for applying an axially directed force to said retainer rod including a tubular wall having first and second open end portions, first connector means for releasably connecting the first end portion of said tubular wall to said casing with the opening in said casing aligned with the opening in the first end portion of said tubular wall, a cover member, second connector means for releasably connecting said cover member with said tubular wall with said cover member extending across the opening in the second end portion of said tubular wall, said cover member and said tubular wall cooperating to at least partially define a piston chamber which has an open end portion disposed in alignment with the opening in said casing, a piston disposed in said chamber, said piston having an outer side surface which is disposed in sliding engagement with an inner side surface of said tubular wall, said piston being movable in said chamber between an initial position in which said piston is disposed adjacent to said first end portion of said tubular wall and a retracted position in which said piston is spaced from said first end portion of said tubular wall, means for connecting said retainer rod with said piston, and spring means for urging said piston toward the initial position, said piston being movable against the urging of said spring means from the initial position toward the retracted position under the influence of force transmitted to said retainer rod from the externally threaded fastener element during tightening of the connection between the internally and externally threaded fastener elements, said first connector means being releasable to enable said tubular wall, piston, retainer member and spring means to be removed from said power tool, said second connector means being releasable to enable said cover member to be disconnected from said tubular wall and connected with said casing to block the opening in said casing upon removal of said tubular wall, piston, retainer member and spring means from said power tool, said second connector means including means for connecting said cover member with said casing to hold said cover member across the opening in said casing after removal of said tubular wall, piston, retainer member and spring means.

2. A power tool as set forth in claim 1 wherein said means for connecting said retainer rod with said piston is releasable to enable said retainer rod to be moved axially relative to said piston to vary the distance which said first end portion of said retainer rod projects axially outwardly from said socket drive element when said piston is in the initial position.

3. A power tool as set forth in claim 1 wherein said chamber has a noncircular cross sectional configuration in a plane extending perpendicular to the longitudinal central axis of said chamber and to the longitudinal central axis of said retainer rod, said piston having an outer side surface with a noncircular cross sectional configuration in a plane extending perpendicular to the longitudinal central axis of said retainer rod, said outer side surface of said piston being disposed in abutting engagement with said surface means to hold said piston and retainer rod against rotation relative to said casing.

4. A power tool as set forth in claim 1 wherein said chamber is at least partially defined by a surface which is formed of a material which is harder than the material forming said piston so that said piston wears to a greater extent than the surface of said chamber upon sliding movement of said piston along the surface of said chamber.

5. A power tool as set forth in claim 1 wherein said chamber has a generally polygonal cross sectional configuration in a plane extending perpendicular to the longitudinal central axis of said chamber and to the longitudinal central axis of said retainer rod, said outer side surface of said piston having a generally polygonal cross sectional configuration in a plane extending perpendicular to the longitudinal central axis of said retainer rod, said outer side surface of said piston being disposed in abutting engagement with a surface of said chamber to hold said piston and retainer rod against rotation relative to said casing.

6. A power tool as set forth in claim 1 further including a plurality of passages formed between said outer side surface of said piston and side surfaces of said chamber to enable fluid to flow between opposite sides of said piston upon movement of said piston in said chamber.

7. A power tool for use in tightening a connection between internally and externally threaded fastener elements, said power tool comprising a casing, a motor disposed within said casing, said motor including a rotatable drive member having a central passage extending therethrough, a rotatable socket drive element connected with said rotatable drive member in said motor and adapted to be connected with a socket which engages the internally threaded fastener element, said socket drive element having a central passage extending therethrough and disposed in axial alignment with the central passage through said rotatable drive member in said motor, a retainer rod extending through the central passage in said rotatable drive member and through the central passage in said socket drive element, said retainer rod having a first end portion which projects axially outwardly from said socket drive element and is connectable with the externally threaded fastener element to hold the externally threaded fastener element against rotation during rotation of the internally threaded fastener element by the socket and a second end portion which projects axially outwardly from one axial end portion of said motor, and means for holding said retainer rod against rotation with said socket drive member and for applying an axially directed force to said retainer rod to urge said retainer rod toward said externally threaded fastener element, said means for holding said retainer rod against rotation and for applying an axially directed force to said retainer rod including surface means connected with said casing for defining a piston chamber disposed outwardly of the one axial end portion of said motor and having a longitudinal central axis extending parallel to the longitudinal central axes of the passages extending through said drive member in said motor and through said socket drive element, said chamber having a generally polygonal cross sectional configuration in a plane extending perpendicular to the longitudinal central axis of said chamber and to the longitudinal central axis of said retainer rod, a piston disposed in said chamber in sliding engagement with said surface means, said piston being movable in said chamber between an initial position in which said piston is disposed in an end portion of said chamber adjacent to said motor and a retracted position in which said piston is spaced further from said motor and said socket drive element than when said piston is in the initial position, said piston having an outer side surface with a generally polygonal cross sectional configuration in a plane extending perpendicular to the longitudinal central axis of said retainer rod, said outer side surface of said piston being disposed in abutting engagement with said surface means to hold said piston and retainer rod against rotation relative to said casing, connector means for releasably connecting said retainer rod with said piston, said connector means being releasable to enable said retainer rod to be moved axially relative to said piston to vary the distance which said first end portion of said retainer rod projects axially outwardly from said socket drive element when said piston is in the initial position, and spring means for urging said piston toward the initial position and the one axial end portion of said motor, said piston being movable against the urging of said spring means from the initial position toward the retracted position under the influence of forces transmitted to said retainer rod from the externally threaded fastener element during tightening of the connection between the internally and externally threaded fastener elements.

8. A power tool as set forth in claim 7 further including tool means connected with said casing for operating said connector means between an engaged condition in which said retainer rod is held against axial movement relative to said piston and a released condition in which said retainer rod is movable axially relative to said piston.

9. A power tool as set forth in claim 7 wherein said retainer rod is hollow and has a plurality of inner side surfaces which define an opening which is adapted to telescopically receive a portion of the externally threaded fastener element.

10. A power tool as set forth in claim 7 wherein said surface means defining said chamber is harder than the material forming said piston so that said piston wears to a greater extent than said surface means upon sliding movement of said piston along said surface means.

11. A power tool as set forth in claim 7 further including a plurality of passages formed between an outer side surface of said piston and said surface means which defines said chamber to enable fluid to flow from end portions of said chamber upon movement of said piston in said chamber.

12. A power tool as set forth in claim 7 further including closure means movable between an open position and a closed position in which said closure means closes one end of said chamber, said piston and retainer rod being removable from said power tool when said closure means is in the open position.

13. A power tool for use in tightening a connection between internally and externally threaded fastener elements, said power tool comprising a casing, a motor disposed within said casing, said motor including a drive member rotatable about the central axis of said motor, angle drive means connected with said drive member for transmitting drive forces in a direction transverse to the central axis of said motor, said angle drive means having a passage extending therethrough in a direction transverse to the central axis of said motor, a rotatable socket drive element connected with said angle drive means and adapted to be connected with a socket which engages the internally threaded fastener element, said socket drive element having a central passage extending therethrough and disposed in axial alignment with the passage through said angle drive means, a retainer rod extending through the passage in said angle drive means and through the central passage in said socket drive element in a direction transverse to the central axis of said motor, said retainer rod having a first end portion which projects axially outwardly from said socket drive element and is connectable with the externally threaded fastener element to hold the externally threaded fastener element against rotation during rotation of the internally threaded fastener element by the socket and a second end portion which projects axially outwardly from said angle drive means, and means for holding said retainer rod against rotation with said socket drive member and for applying an axially directed force to said retainer rod to urge said retainer rod toward said externally threaded fastener element in a direction transverse to the central axis of said motor, said means for holding said retainer rod against rotation and for applying an axially directed force to said retainer rod including surface means connected with said casing for defining a piston chamber having a longitudinal central axis extending parallel to the longitudinal central axes of the passages extending through said angle drive means and through said socket drive element and transverse to the central axis of said motor, a piston disposed in said chamber in sliding engagement with said surface means, said piston being movable in said chamber in a direction transverse to the central axis of said motor between an initial position in which said piston is disposed in an end portion of said chamber adjacent to said angle drive means and a retracted position in which said piston is spaced further from said angle drive means and said socket drive element than when said piston is in the initial position, and biasing means for urging said piston toward the initial position, said piston being movable against the urging of said biasing means from the initial position toward the retracted position under the influence of forces transmitted to said retainer rod from the externally threaded fastener element during tightening of the connection between the internally and externally threaded fastener elements.

14. A power tool as set forth in claim 13 wherein said chamber has a noncircular cross sectional configuration in a plane extending perpendicular to the longitudinal central axis of said chamber and to the longitudinal central axis of said retainer rod, said piston having an outer side surface with a noncircular cross sectional configuration in a plane extending perpendicular to the longitudinal central axis of said retainer rod, said outer side surface of said piston being disposed in abutting engagement with said surface means to hold said piston and retainer rod against rotation relative to said casing.

15. A power tool as set forth in claim 13 wherein said biasing means includes a spring disposed in said chamber in abutting engagement with said piston.

16. A power tool as set forth in claim 13 further including closure means movable between an open position and a closed position in which said closure means closes one end of said chamber, said piston and retainer rod being removable from said power tool when said closure means is in the open position.

17. A power tool as set forth in claim 13 wherein said angle drive means includes means for defining an opening through which said retainer rod extends, said means for holding said retainer against rotation and for applying an axially directed force to said retainer rod including a tubular wall having first and second open end portions, said surface means being disposed within said tubular wall, first connector means for releasably connecting the first end portion of said tubular wall to said angle drive means with the opening in said angle drive means aligned with the opening in the first end portion of said tubular wall, a cover member, second connector means for releasably connecting said cover member with said tubular wall with said cover member extending across the opening in the second end portion of said tubular wall, said cover member and said tubular wall cooperating to at least partially define said piston chamber which has an open end portion disposed in alignment with the opening in said casing, said first connector means being releasable to enable said tubular wall, piston and retainer rod to be removed from said power tool, said second connector means being releasable to enable said cover member to be disconnected from said tubular wall and connected with said angle drive means to block the opening in said angle drive means upon removal of said tubular wall, piston and retainer rod from said power tool, said second connector means including means for connecting said cover member with said casing to hold said cover member across the opening in said casing after removal of said tubular wall, piston and retainer rod.

* * * * *